US007368214B2

(12) United States Patent
Ishiyama et al.

(10) Patent No.: US 7,368,214 B2
(45) Date of Patent: May 6, 2008

(54) ELECTROSTATIC LATENT IMAGE DEVELOPING TONER AND MANUFACTURING METHOD THEREOF

(75) Inventors: Takao Ishiyama, Minamiashigara (JP); Hiroshi Nakazawa, Minamiashigara (JP); Masanobu Ninomiya, Minamiashigara (JP); Hideo Maehata, Minamiashigara (JP); Yutaka Sugizaki, Minamiashigara (JP); Shinpei Takagi, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 330 days.

(21) Appl. No.: 11/143,462

(22) Filed: Jun. 3, 2005

(65) Prior Publication Data

US 2006/0105258 A1 May 18, 2006

(30) Foreign Application Priority Data

Nov. 18, 2004 (JP) ..... 2004-334233

(51) Int. Cl.
*G03G 9/08* (2006.01)

(52) U.S. Cl. ..... 430/111.4; 430/108.1; 430/108.4; 430/109.1; 430/110.2; 430/109.4; 430/137.14

(58) Field of Classification Search ..... 430/111.4, 430/108.4, 108.1, 109.1, 110.2, 137.14, 109.4
See application file for complete search history.

(56) References Cited

U.S. PATENT DOCUMENTS

2006/0210904 A1* 9/2006 Ninomiya et al. ..... 430/110.2
2006/0275679 A1* 12/2006 Ishiyama et al. ..... 430/42

* cited by examiner

*Primary Examiner*—Mark A. Chapman
(74) *Attorney, Agent, or Firm*—Oliff & Berridge, PLC

(57) ABSTRACT

An electrostatic latent image developing toner including, as a binder resin, a crystalline resin and at least one kind of non-crystalline resin, wherein, in a dynamic viscoelasticity measurement by a sine wave vibration method, a minimum value of the relaxation elasticity H in a relaxation spectrum obtained from frequency dispersion characteristics measured at temperatures of 60 and 80 degrees centigrade with a measurement frequency set in the range of 0.1 to 100 rad/sec and measurement strain set in the range of 0.02 to 4.5% is in the range of 10 to 900 Pa/cm$^2$, and a relaxation time $\lambda$ corresponding to the minimum value is in the range of 1 to 10,000 sec.

19 Claims, No Drawings

ELECTROSTATIC LATENT IMAGE DEVELOPING TONER AND MANUFACTURING METHOD THEREOF

CROSS-REFERENCE TO RELATED APPLICATION

This application claims priority under 35 USC 119 from Japanese Patent Application No. 2004-334233, the disclosure of which is incorporated by reference herein.

BACKGROUND OF THE INVENTION

1. Field of the Invention

The present invention relates to an electrostatic latent image developing toner that is used when an electrostatic latent image formed by an electrophotography method or an electrostatic recording method is developed with a developer and a manufacturing method thereof.

2. Description of the Related Art

A method of visualizing image information through an electrostatic latent image such as an electrophotography method is presently used in various fields. In the electrophotography method, an electrostatic latent image is formed on a photoreceptor by charging and exposure and visualized through developing the electrostatic latent image with a developer including an electrostatic latent image developing toner (hereinafter, in some cases, simply referred to as "toner"), transferring and fixing.

As a developer that is used here, a two-component developer made of a toner and a carrier and a single-component developer that singly uses a magnetic toner or a non-magnetic toner are known. As a manufacturing method of the toner, normally, a kneading-pulverizing process in which a thermo-plastic resin is melted and kneaded together with a pigment, a charge control agent and a releasing agent such as wax, followed by pulverizing and classifying after cooling is used.

In some cases, as need arises, in order to improve the fluidity and the cleaning property, inorganic or organic particles are added to a surface of a toner particle. The method can produce a rather excellent toner; however, since a toner shape is substantially limited to an amorphous one, particles tend to be generated, and a releasing agent and a colorant are likely to be exposed on a surface, whereby in some cases, problems such as deterioration of the developability and image quality due to stress in a developing device, contamination to other members and so on may be caused.

In recent years, as a process that makes it possible to intentionally control a shape and a surface structure of a toner, a manufacturing process of toner according to an emulsion-polymerization flocculation method has been proposed (for example, see JP-A Nos. 63-282752 and 06-250439). This is a manufacturing method in which, in general, after a dispersion of resin particles is prepared by means of emulsion polymerization and a colorant dispersion in which a colorant is dispersed in a solvent is prepared, these are blended to form flocculated particles corresponding to a toner particle diameter, followed by heating to melt and unite the same. According to this method, to some extent, the toner shape can be controlled and the charging property and the durability can be improved; however, an internal structure becomes substantially homogeneous. Accordingly, there still remain problems in the peeling property of toner receiving bodies at the fixing, the stability of the transparency at the time of OHP output, and the difference in charge amount between colors in the color toner.

Thus, in the electrophotography process, in order for the toner to stably maintain the performance even under various mechanical stresses, it is necessary to suppress exposure a releasing agent at the surface, enhance the surface hardness and improve the mechanical strength of the toner itself without damaging the fixing property, and combine sufficient charging property and fixing property.

Furthermore, from the viewpoints of recent high-speed processing and ensuring low energy consumption, a toner having uniform charging property, maintainability, toner strength and a narrow particle size distribution becomes more and more important. Furthermore, in view of the high-speed processing and power saving properties of these machines, the low temperature fixing property becomes more and more necessary.

From the viewpoint of the foregoing low temperature fixing, as a method of lowering a fixing temperature of the toner itself, a technology in which a glass transition temperature (Tg) of a binder resin for toner is lowered is generally adopted. However, since powder tends to aggregate (blocking) and the storage stability of the toner on a fixed image is lost when the Tg is excessively lowered, from a practical standpoint, the lower limit is 60 degrees centigrade. This glass transition point is a design point of many of commercially available toner resins. That is, there is a problem in that, according to a method of lowering the glass transition point, a toner that can be fixed at a temperature lower than that which is currently possible cannot be obtained. When a plasticizer is used, the fixing temperature can be lowered; however, there is a problem in that during storage of the toner or in a developing device, blocking occurs.

As a measure that combines inhibition of blocking, image storage stability up to 60 degrees centigrade and low temperature fixing property, a technology that uses a crystalline resin as a binder resin that constitutes the toner has been known from long ago (for example, see JP-B No. 56-13943). Furthermore, for the purpose of offset prevention, pressure fixing and so on, a technology that uses a crystalline resin has been known from long ago (for example, see JP-B Nos. 62-39428 and 63-25335). However, according to the foregoing disclosed technologies, since a melting point of a resin that is used is excessively low such as 62 to 66 degrees centigrade, there are problems in the reliability of powder and images and insufficient fixing property of the crystalline resin onto paper.

As a crystalline resin that is expected to improve the fixing property onto paper, a polyester resin can be cited. As a technology that uses a crystalline polyester resin in toner, there is a technology in which a non-crystalline polyester resin having a glass transition point of 40 degrees centigrade or more and a crystalline polyester resin having a melting point in the range of 130 to 200 degrees centigrade are blended and used (for example, see JP-B No. 62-39428). However, this technology, though having excellent pulverizing property and blocking resistance, cannot achieve a low temperature fixing property beyond that achieved conventionally since the melting point of the crystalline polyester resin is high.

In order to overcome the foregoing problems, a technology that uses a toner in which a crystalline resin having a melting point of 110 degrees centigrade or less and a non-crystalline resin are blended is proposed (for example, see JP-B No. 04-30014). However, when a non-crystalline resin is blended with a crystalline resin, there are practical problems in that lowering of the melting point of the toner is caused, toner blocking is caused, and the storage stability of images is deteriorated. Furthermore, when the non-crystalline resin component is contained in a large amount, since the characteristics of the non-crystalline resin are largely exhibited, it is difficult to lower the fixing temperature more than in conventional technologies. Accordingly, there is a problem in that unless the crystalline resin is used singly, if mixed, with only a slight amount of the non-crystalline resin, as the toner resin, practical use is difficult.

Furthermore, as the technologies that use a crystalline polyester resin, some proposals have been made (for example, see JP-A Nos. 04-120554, 04-239021 and 05-165252). In these technologies, the crystalline polyester resin is a resin that uses a carboxylate component of terephthalic acid and alkylene glycol or alicyclic alcohol having a small number of carbon atoms. These polyester resins, though described as crystalline polyester resins in the foregoing literature, are substantially partially crystalline polyester resins. As a result, a change in viscosity of the toner (binder resin) relative to a temperature is not steep, and accordingly, there is no problem in the blocking property and the storage stability of image, however, in heat roll fixing, low temperature fixing cannot be realized.

Still furthermore, a toner that contains as a main component a crystalline polyester resin having a cross-linking structure has been shown to be excellent in blocking resistance and image storage stability, and capable of realizing low temperature fixing (for example, see JP-A No. 2001-117268). However, there is a problem in that in oil-less fixing the peeling property is not stable. In addition, when a crystalline resin is used singly, though the low temperature fixing, the toner storage property, and the document storage stability can be assuredly improved, there are problems in that the strength of a developed image is low and an image can be easily damaged by scratching and so on.

Furthermore, there is a problem in that when double-side printing is carried out with the foregoing toners by use of a copy machine or a printer, in particular when one side is printed with a solid image and the other side is printed with a half-tone image, since the fixing property differs largely, paper printed with images warps (so-called curling).

Still furthermore, from the viewpoint of improving the fixing property in a high-speed and low-pressure fixing system, it is disclosed that an improvement in the oil-less stripping property owing to an improvement in the dispersing property of the releasing agent inside of the toner is achieved by defining the relaxation elasticity and the relaxation time obtained from dynamic viscoelasticity measurement (for example, see JP-A No. 2000-81721). According to this method, since a behavior of the toner at the fixing relates to the deformation of toner particles in a fixing system and a stress relaxation phenomenon thereof and, among these, to a change of state of the toner from a glass state to a molten state affected by a temperature, certainly the fixing characteristics and the stress of a fixed image derived from an internal structure of the toner, which cannot be sufficiently controlled by the storage elasticity and loss elasticity that have so far generally been used as parameters or the loss tangent which is a ratio thereof, can be accurately controlled to a certain degree, whereby the internal stress can be reduced. However, according to this method, in some cases, problems such as dependence of the fixing property on the process (for instance, a process speed) and warping of an image, particularly in the case of thin paper, when double-sided printing is applied cannot be avoided. Accordingly, practical application of a toner that can further eliminate these problems is demanded.

SUMMARY OF THE INVENTION

A first aspect of the present invention is to provide an electrostatic latent image developing toner that includes, as a binder resin, a crystalline resin and at least one kind of non-crystalline resin, wherein, in dynamic viscoelasticity measurement by a sine wave vibration method, a minimum value of relaxation elasticity H in a relaxation spectrum obtained from frequency dispersion characteristics measured at 60 and 80 degrees centigrade with a measurement frequency set in the range of 0.1 to 100 rad/sec and a measurement strain in the range of 0.02 to 4.5% is in the range of 10 to 900 Pa/cm$^2$ and a relaxation time $\lambda$ corresponding to the minimum value is in the range of 1 to 10,000 sec.

A second aspect according to the invention is to a manufacturing method of the electrostatic latent image developing toner, which includes mixing at least a dispersion of resin particles in which a resin containing a crystalline resin having a volume average particle diameter of 1 μm or less is dispersed, a colorant dispersion in which a colorant is dispersed, and a releasing agent dispersion process in which a releasing agent is dispersed to form flocculates in the presence of an aluminum ion; and after the flocculates are stopped in growing heating to fuse and unite the same.

DETAILED DESCRIPTION OF THE INVENTION

According to the present invention, an excellent electrostatic latent image developing toner that is excellent in the low temperature fixing property and less in the warping (curling) properties of sheet when double-side printing is applied to thin paper and the low dependence on process speed of the fixing property; and a manufacturing method thereof can be provided.

In what follows, the invention will be detailed.

Electrostatic Latent Image Developing Toner

An electrostatic latent image developing toner according to the invention includes, as a binder resin, a crystalline resin and at least one kind of non-crystalline resin, wherein, in the dynamic viscoelasticity measurement due to a sine wave vibration method, a minimum value of the relaxation elasticity H in a relaxation spectrum obtained from a frequency dispersion characteristics measured at 60 and 80 degrees centigrade with a measurement frequency set in the range of 0.1 to 100 rad/sec and a measurement strain in the range of 0.02 to 4.5% is in the range of 10 to 900 Pa/cm$^2$ and a relaxation time $\lambda$ corresponding to the minimum value is in the range of 1 to 10,000 sec.

A reason for an image after the fixing becoming likely to warp is in that when a fixed toner becomes, from an adhesive state (viscosity dominant state), a solid state (elasticity dominant state) a large contraction is caused. As mentioned above, the behavior at the fixing of the toner relates to deformation of the toner particles in a fixing system and a stress relaxation phenomenon thereof, accordingly, it is considered that when the stress relaxation behavior of the toner to which a temperature is applied is controlled, the warp of an image after the fixing can be reduced.

In the invention, it is found that when the dynamic viscoelasticity measurement by a sine wave vibration method is carried out, as conditions, with a frequency set in the range of 0.1 to 100 rad/sec and a measurement strain set in the range of 0.02 to 4.5%, and each of a minimum value of the relaxation elasticity H in a relaxation spectrum obtained from a frequency dispersion characteristics measured at 60 and 80 degrees centigrade and a relaxation time λ corresponding to the minimum value is set in a definite range, the stress generated during the fixing can be controlled and thereby the contraction due to the stress relaxation of the toner can be reduced.

The behavior of the toner at the fixing can be described as a sum of an elastic deformation and a viscous deformation. When it is assumed that the elasticity is Hookian one and the viscosity is Newtonian one, that is, the elasticity and the viscosity coefficient do not change with time, a viscoelastic deformation (shear velocity) can be expressed with an equation (1) below.

$$d\epsilon/dt=1/G\times d\sigma\cdot dt+\sigma/\eta \qquad \text{formula (1)}$$

(ϵ: shear strain, σ: shearing stress, G: shear elasticity, η: viscosity, and t: time)

Here, when the deformation ϵ is assumed not to change with time, the stress can be expressed with a following formula (2).

$$\sigma=\sigma_0\exp(-t/\tau) \qquad \text{formula (2)}$$

($\sigma_0$: stress when t=0, t=time, and τ: relaxation time (=η/G)

That is, dϵ/dt=0 means that a time change when the rigorousness of a thermal movement having one freedom comes to an equilibrium value owing to the strain is expressed with $\sigma_0\exp(-t/\tau)$. Accordingly, the stress σ decreases with time. This is defined as a relaxation. Specifically, it is a reduction rate at t=τ, and $\sigma/\sigma_0$ becomes 1/e (e is natural logarithm) and expresses a time until the stress σ becomes 1/e, that is, 0.3679 times; accordingly, it can express a speed of the relaxation.

In general, the stress relaxation of the toner as a whole at the fixing is a sum total of relaxations due to various small flow deformations inside of the toner. Since the inside of actual toner is not homogeneous but a composite, the relaxations become important. Furthermore, the foregoing relaxation is generally expressed with a multi-element model and relationship between stress and strain at this time can be expressed with a following formula (3).

$$\sigma/\epsilon_0=G(t)=\Sigma Gi\cdot\exp(-t/\tau i) \qquad \text{formula (3)}$$

The G(t) is the relaxation elasticity, expresses the elasticity for each minute time of the toner deformation and varies with time. Accordingly, even in case of the same toner, when rapidly deformed, it exhibits the elasticity, when deformed slowly, it exhibits the viscosity, and, in an intermediate region, it exhibits the viscoelasticity. A time necessary for the deformation is defined as a timescale (measurement time), and this affects on the mechanical property of the toner.

Furthermore, when the relaxation time τ is smaller, the G becomes larger, and, at a certain time t, since the relaxations occur according to the respective τ, when the relaxation time is applied in place of the deformation time, G(t) can be expressed with an formula (4).

$$G(t)=\int G(\tau)\cdot\exp(-t/\tau)d\tau \qquad \text{formula (4)}$$

The G(t) in this formula is generally called as a relaxation spectrum.

Furthermore, in general, the toner is made of a polymer; accordingly, the relaxation spectrum includes a wedge portion and a box portion. It is known that in the wedge portion, the relaxation of a side chain of a polymer appears, and inside of the wedge portion, fluidization relaxation due to micro-Brownian movement of a segment mainly appears; and in the box portion, the fluidization relaxation due to the macro-Brownian movement of the segment appears. That is, as a magnitude of a portion that moves becomes larger, the relaxation time becomes longer and the elasticity to which the larger portion contributes decreases; on the contrary, as a moving portion becomes smaller, the involving elasticity becomes larger.

As will be described below, when the frequency dispersion characteristics of the storage elasticity of the toner at a fixed temperature is measured to obtain the relaxation spectrum therefrom, a minimum value of the relaxation elasticity H is present between the wedge portion (elasticity predominant region) and the box portion (viscosity predominant region); accordingly, when a value of the relaxation elasticity H at the minimum value and the relaxation time λ that shows the minimum value each are set in a definite range, the balance between the elasticity and the viscosity of the toner at the fixing, that is, a time of stress relaxation to the deformation can be controlled.

The inventors, as mentioned above, found a range of the minimum value of the relaxation elasticity H that can reduce the warp of an image after the fixing and a range of the relaxation time λ that shows the minimum value, carried out a structure control of the toner that can satisfy the foregoing characteristics, and thereby achieved the invention.

As mentioned above, in the invention, it is necessary that the minimum value of the relaxation elasticity H in the relaxation spectrum is in the range of 10 to 900 Pa/cm$^2$ and the relaxation time λ corresponding to the minimum value is in the range of 10 to 10,000 sec.

When the minimum value of the relaxation elasticity H is smaller than 10 Pa/cm$^2$, the nonuniformity in a binder resin of the toner is large and the responsiveness of the strain decreases; accordingly, though it is effective on the dependence on process speed of the cold offset (low temperature offset), when thin paper is used or the double side printing is applied, the warp of the sheet tends to be larger and the fixing strength tends to decrease as well. Furthermore, when the minimum value of the relaxation elasticity H is larger than 900 Pa/cm$^2$, the contraction due to the stress relaxation of the fixed toner becomes larger; accordingly, in particular when the process speed exceeds 300 mm/sec and thin paper is used as a sheet, although there is no problem of the fixing strength and the warp, in some cases, the cold offset tends to occur.

In order to make the toner characteristics compatible, when the relaxation time λ corresponding to the minimum value is adjusted, the problem can be overcome. When the relaxation time λ corresponding to the minimum value is small, the warp of an image can be reduced and the fixing strength can be improved; and when the relaxation time λ is larger, the process speed dependence of the cold offset can be lowered. When the relaxation time is shorter than 1 sec, as mentioned above, the dependence on process speed of the cold offset becomes larger, and when it is longer than 10,000 sec, contrary to the above, the warp ensuing the image contraction becomes larger and the nonuniformity in the toner binder resin increases, resulting in incapability of obtaining the strength of the fixed image.

The minimum value of the relaxation elasticity H is preferably in the range of 10 to 900 Pa/cm$^2$, and more preferably in the range of 50 to 900 Pa/cm$^2$. Furthermore, the relaxation time λ corresponding to the minimum value is preferably in the range of 10 to 10,000 sec and more preferably in the range of 10 to 9,000 sec.

The relaxation spectrum in the invention, in the dynamic viscoelasticity measurement according to a sine wave vibration method, can be obtained from the frequency dispersion characteristics measured at temperatures of 60 and 80 degrees centigrade with a measurement frequency set in the range of 0.1 to 100 rad/sec and measurement strain set in the range of 0.02 to 4.5%.

As the measurement of the dynamic viscoelasticity, the frequency dispersion of the dynamic viscoelasticity measurement owing to a sine wave vibration method is preferably used. Furthermore, in the frequency dispersion, 60 degrees centigrade that is in a transition region from a glass state of the toner and affects on both the fixing property and the hot storage stability of the toner is preferably used as a measurement temperature. Furthermore, the strain at the measurement, though depending on the rigidity of a resin, is set in the range of 0.02 to 4.5% in the invention.

The relaxation spectrum is obtained by preparing a convolution curve (master curve) from the frequency dispersion characteristics of the storage elasticity in the 60 and 80 degrees centigrade by use of well known a temperature-time conversion law, followed by mathematically converting the convolution curve to the relaxation elasticity and relaxation time.

In what follows, a method of obtaining a relaxation spectrum in the invention will be specifically described.

In the beginning, the frequency dispersion of the storage elasticity in the invention is obtained according to the following procedure. As a measurement device, an (ARES System, manufactured by Texas Instrument Corp.) is used. A parallel plate having a diameter of 25 mm is prepared, after zero point adjustment is applied, tablets that are beforehand molded by use of a room temperature (cold) press and adjusted into a thickness in the range of 2.1 to 2.3 mm are set on the measurement jig. Subsequently, a temperature of the measurement jig is adjusted to 95 degrees centigrade to heat for 5 min. Furthermore, the thickness is adjusted to 2.0 mm, followed by cooling to a temperature of 60 degrees centigrade at a temperature lowering speed of 1° C./min. After a constant temperature is reached, with a frequency in the range of 0.1 to 100 rad/sec, the strain rate is controlled so as to be 0.02 to 4.5%, the respective storage elasticity at that time are obtained, and the frequency dispersion characteristics of the storage elasticity is obtained. Furthermore, by setting the temperature at 80 degrees centigrade, a similar measurement is carried out.

In the next place, obtained frequency characteristic curves of the storage elasticity at temperatures 60 and 80 degrees centigrade are convoluted based on a principle of convolution to prepare a master curve. At this time, a curve at 60 degrees centigrade is set as a reference. Then, according to the foregoing method, the master curve is converted into a relaxation spectrum.

The relaxation spectrum is obtained as relationship between a relaxation time $\lambda$ on a horizontal axis and a relaxation elasticity H on a vertical axis. From a minimum point that appears in the middle of decrease of the relaxation elasticity from low relaxation times to high relaxation times of the relaxation spectrum, the minimum value of the relaxation elasticity H and the relaxation time corresponding thereto are obtained.

Furthermore, in general, the frequency in the dynamic viscoelasticity is known to correspond to the speed. From this, in the invention as well, it is found that by controlling the frequency dispersion characteristics of the storage elasticity, the low temperature fixing property and the reduction of the dependence on the process speed (fixing speed) of the fixing property can be combined.

That is, the storage elasticity in the frequency dispersion characteristics measured at 60 degrees centigrade with the measurement frequency set in the range of 0.1 to 100 rad/sec and the measurement strain in the range of 0.02 to 4.5% corresponds to the hardness of the toner in a transition region from a glass state in each of the process speeds; accordingly, when a gradient K of the frequency dispersion curve is set in a definite range, the low temperature fixing property and the decrease of the dependence on the process speed can be optimized.

In the invention, the gradient K is preferably set in the range of 0.12 to 0.87 $Pa/cm^2 \cdot °C$., and more preferably in the range of 0.15 to 0.8 $Pa/cm^2 \cdot °C$. When the gradient K is smaller than 0.12 $Pa/cm^2 \cdot °C$., the dependence on the process speed of a machine of the fixing property becomes smaller; however, since the nonuniformity inside of the toner binder resin is large and the responsiveness of the strain becomes lower, in some cases, sufficient fixing strength cannot be obtained. Furthermore, when the gradient K is larger than 0.87 $Pa/cm^2 \cdot °C$., the machine process dependence of the fixing property becomes large, in particular when the process speed exceeds 300 mm/sec, the hardness of the toner at the fixing becomes larger; as a result, sufficient fixing property cannot be obtained and the cold offset may result in some cases.

The gradient K, in the frequency dispersion curve of the storage elasticity at the 60 degrees centigrade, is obtained as a change gradient of the respective storage elasticity corresponding to the frequencies 0.1 and 100 rad/sec.

Accordingly, a toner that satisfies the condition involving the minimum value of the relaxation spectrum and further the condition of the gradient in the foregoing frequency curve is excellent in the blocking resistance, can improve the low temperature fixing property, and not only can make the curl of a sheet smaller when thin paper is subjected to the double-side printing but also can largely reduce the speed dependence of the fixing property of the toner.

In the next place, a configuration of an electrostatic latent image developing toner according to the invention will be described.

A binder resin in the invention contains a crystalline resin and at least one kind of non-crystalline resin. In the invention, the binder resin means a resin that becomes a main component in an ordinary toner particle (matrix particle). However, for instance, in a core/shell type toner particle described later, not only a core but also a shell is contained in the resin.

The "crystalline resin" in the invention indicates one that in a differential scanning calorimetry (DSC) shows not a step-wise change in a heat absorption amount but a clear heat absorption peak.

The crystalline resin, as far as it has the crystallinity, is not particularly restricted. Specifically, a crystalline polyester resin, a crystalline vinyl-base resin and so on can be cited. However, from viewpoints of the fixing property to paper at the fixing, the fixing property and the melting point adjustment in a preferable range, the crystalline polyester resin is preferable. Furthermore, a straight fatty acid base crystalline polyester resin having a proper melting point is more preferable.

The crystalline polyester resin is synthesized from an acid (dicarboxylic acid) component and an alcohol (diol) component. In the invention, a copolymer in which to a crystalline polyester resin main chain, other component is copolymerized at a ratio of 50% by mass or less is also included in the crystalline polyester resin.

A manufacturing method of the crystalline polyester resin is not particularly restricted. A general polyester polymerizing method in which an acid component and an alcohol component are allowed to react can be used to manufacture. For instance, a direct polycondensation method, an ester exchange method and so on can be cited. These can be appropriately used to manufacture depending on the kind of monomer.

The crystalline polyester resin can be manufactured at a polymerization temperature in the range of 180 to 230 degrees centigrade, and, as needs arise, a reaction system is depressurized to allow reacting while removing water and alcohol generated at the condensing. When a monomer is not dissolved or miscible under a reaction temperature, a high boiling point solvent may be added as a solubilizing agent to dissolve. The polycondensation reaction is carried out while distilling the solubilizing agent. When a less compatible monomer is present in the copolymerization reaction, the less compatible monomer and an acid or alcohol that is being reacted with the monomer are beforehand condensed, followed by polycondensating with a main component.

The catalysts that can be used when the crystalline polyester resin is manufactured include compounds of alkali metal such as sodium and lithium; compounds of alkaline earth metals such as magnesium and calcium; compounds of metals such as zinc, manganese, antimony, titanium, tin, zirconium and germanium; and phosphites, phosphates and amine compounds.

Specifically, compounds such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyltin, dibutyltin dichloride, dibutyltin oxide, diphenyltin oxide, zirconium tetrabutoxide, zirconium naphthenate, zirconyl carbonate, zirconyl acetate, zirconyl stearate, zirconyl octylate, germanium oxide, triphenyl phosphite, tris(2,4-t-butylphenyl) phosphite, ethyltriphenyl phosphonium bromide, triethylamine, and triphenylamine can be cited.

On the other hand, examples of the crystalline vinyl type resins include vinyl type resins that use, as a monomer, (meth)acrylic acid ester of long chain alkyl or alkenyl(meth) acrylic acid ester such as amyl(meth)acrylate, hexyl(meth) acrylate, heptyl(meth)acrylate, octyl(meth)acrylate, nonyl (meth)acrylate, decyl(meth)acrylate, undecyl(meth)acrylate, tridecyl(meth)acrylate, myristyl(meth)acrylate, cetyl(meth) acrylate, stearyl(meth)acrylate, oleyl(meth)acrylate, and behenyl(meth)acrylate. In the present specification, the description of "(meth)acryl" means that both "acryl" and "methacryl" are contained.

The melting point of the crystalline resin in the invention is preferably in the range of 50 to 120 degrees centigrade, and more preferably in the range of 60 to 110 degrees centigrade. When the melting point is lower than 50 degrees centigrade, problems may arise in some cases in the storage stability of the toner and the storage stability of the toner image after fixing. On the other hand, when the melting point is higher than 120 degrees centigrade, in some cases, sufficient low-temperature fixing cannot be obtained when compared with conventional toners.

The melting point of the crystalline resin can be measured by use of a differential scanning calorimeter (trade name: DSC-7, manufactured by Perkin-Elmer Corp.). In the calorimeter, a temperature compensation of a detector is applied with melting points of indium and zinc, and an amount of heat is compensated with a heat of fusion of indium. When a sample, with an aluminum pan and with a vacant pan set as a reference, is measured at a temperature rising speed of 10° C./min from room temperature to 150 degrees centigrade, the melting point of the crystalline resin can be obtained as a melting peak temperature of differential scanning calorimetry shown in ASTM D3418-8. In addition, in some cases, the crystalline resin exhibits a plurality of melting peaks; however, in the invention, the maximum peak is regarded as the melting point.

The "non-crystalline resin" in the invention is one that, in the foregoing DSC, does not exhibit a clear absorption peak but a step-wise absorption change.

As the non-crystalline resin in the invention, known resin materials can be used. However, a non-crystalline polyester resin is particularly preferable.

The foregoing non-crystalline polyester resin is one that is obtained by polycondensating mainly polyvalent carboxylic acids and polyhydric alcohols.

As polyvalent carboxylic acids that are used to manufacture the non-crystalline polyester resin in the invention, an aromatic dicarboxylic acid such as terephthalic acid, isophthalic acid, orthophthalic acid, 1,5-naphthalene dicarboxylic acid, 2,6-naphthalene dicarboxylic acid and diphenic acid; an aromatic oxycarboxylic acid such as p-oxybenzoic acid and p-(hydroxyethoxy)benzoic acid; an aliphatic dicarboxylic acid such as succinic acid, alkylsuccinic acid, alkenylsuccinic acid, adipic acid, azelaic acid, sebacic acid, and dodecane dicarboxylic acid; and an unsaturated aliphatic and an alicyclic dicarboxylic acid such as fumaric acid, maleic acid, itaconic acid, mesaconic acid, citraconic acid, hexahydrophthalic acid, tetrahydrophthalic acid, dimer acid, trimer acid, hydrogenated dimer acid, cyclohexane dicarboxylic acid, and cyclohexene dicarboxylic acid can be used. Furthermore, as polyvalent carboxylic acid, other than the above, a tri- or more-valent carboxylic acid such as trimellitic acid, trimethic acid and pyromellitic acid can be used.

In the invention, polyvalent carboxylic acids containing 5% by mole or more of cyclohexane dicarboxylic acid are preferably used, and furthermore an amount of cyclohexane dicarboxylic acid used is preferably in the range of 10 to 70% by mole of the polyvalent carboxylic acid, more preferably in the range of 15 to 50% by mole, and particularly preferably in the range of 20 to 40% by mole. Furthermore, as the cyclohexane dicarboxylic acid, at least one kind of 1,4-cyclohexane dicarboxylic acid, 1,3-cyclohexane dicarboxylic acid and 1,2-cyclohexane dicarboxylic acid can be used. Still furthermore, one in which hydrogen atoms of a cyclohexane ring are partially substituted by an alkyl group and so on may be combined. When a content of the cyclohexane dicarboxylic acid is less than the foregoing range, the fixing property is not exhibited, and when it is more than the foregoing range, a unit price goes up and a cost problem may be caused.

As the polyhydric alcohols that is used to manufacture the non-crystalline polyester resin, aliphatic polyhydric alcohols, alicyclic polyhydric alcohols, and aromatic polyhydric alcohols can be exemplified. As the aliphatic polyhydric alcohols, aliphatic diols such as ethylene glycol, propylene glycol, 1,3-propane diol, 2,3-buthane diol, 1,4-buthane diol, 1,5-pentane diol, 1,6-hexane diol, neopentyl glycol, diethylene glycol, dipropylene glycol, dimethylol heptane, 2,2,4-trimethyl-1,3-pentane diol, polyethylene glycol, polypropylene glycol, polytetramethylene glycol, lactone base polyester polyol that is obtained by applying ring-opening polymerization to lactone such as ϵ-caprolactone, and triols and tetraols such as trimethylol ethane, trimethylol propane, glycerin, and pentaerythritol can be exemplified.

As the foregoing alicyclic polyhydric alcohols, 1,4-cyclohexane diol, 1,4-cyclohexane dimethanol, spiroglycol, hydrogenated bisphenol A, ethylene oxide adduct and propylene oxide adduct of hydrogenated bisphenol A, tricyclodecane diol, tricyclodecane dimethanol, dimer diol and hydrogenated dimer diol can be exemplified.

As the aromatic polyhydric alcohols, p-xylene glycol, m-xylene glycol, o-xylene glycol, 1,4-phenylene glycol, ethylene oxide adduct of 1,4-phenylene glycol, bisphenol A, ethylene oxide adduct and propylene oxide adduct of bisphenol A and so on can be cited.

Furthermore, in order to improve the environmental stability of the toner charging property, in some cases, a polar group at a terminal of a polyester molecule is blocked and a mono-functional monomer is introduced in the polyester resin. As the mono-functional monomer, mono-carboxylic acids such as benzoic acid, chlorobenzoic acid, bromobenzoic acid, p-hydroxybenzoic acid, mono-ammonium sulfobenzoate, mono-sodium sulfobenzoate, cyclohexylaminocarbonylbenzoic acid, n-dodecylaminocarbonylbenzoic acid, tertiary-butylbenzoic acid, naphthalene carboxylic acid, 4-methylbenzoic acid, 3-methylbenzoic acid, salicylic acid, thiosalycilic acid, phenylacetic acid, acetic acid, propionic acid, lactic acid, iso-lactic acid, octane carboxylic acid, lauric acid, stearic acid, and low alkyl esters thereof, or mono-alcohols such as aliphatic alcohols, aromatic alcohols, and alicyclic alcohols can be used.

Furthermore, as the known non-crystalline resins, styrene-acryl base resins can be used. Specifically, polymers of monomers such as styrenes such as styrene, p-chlorostyrene and α-methyl styrene; esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; vinyl nitriles such as acrylonitrile and methacrylonitrile; vinyl ethers such as vinyl methyl ether and vinyl isobutyl ether; vinyl ketones such as vinyl methyl ketone, vinyl ethyl ketone, and vinyl isopropenyl ketone; and polyolefins such as ethylene, propylene, and buthadiene, copolymers or mixtures obtained by combining at least two kinds thereof, furthermore non-vinyl resins such as an epoxy resin, a polyester resin, a polyurethane resin, a polyamide resin, a cellulose resin and a polyether resin, or mixtures of these and the foregoing vinyl resins and graft polymers obtained when vinyl monomers are polymerized under co-existence thereof can be used.

The glass transition point of the non-crystalline resin used in the invention is indispensable to be 40 degrees centigrade or more, preferably 45 degrees centigrade or more and more preferably 50 degrees centigrade or more and preferably 50 degrees centigrade or more and less than 90 degrees centigrade. When the glass transition point is less than 40 degrees centigrade, during handling or storage, the toner tends to flocculate, that is, there may occur a problem of the storage stability, and since the toner contracts largely the curl of sheet when double-side printing is applied becomes larger. Furthermore, the glass transition point is 90 degrees centigrade or more, the fixing property is unfavorably deteriorated.

The softening point of the non-crystalline resin that is used in the invention is preferably in the range of 60 to 90 degrees centigrade. A toner, of which softening point is set lower than this, tends to flocculate during handling or storage. In particular, when it is stored long, in some cases, the fluidity may be largely deteriorated. When the softening point is higher than this, the fixing property may be damaged. Furthermore, since a fixing roll has to be heated at a higher temperature, a material of the fixing roll and a material of a base material on which a copy is made are restricted.

The softening point here is a temperature when the melt viscosity that is measured with a flow tester (trade name: CFT-500 manufactured by Shimadzu Corporation) with a nozzle having a diameter of 1 mm and a thickness of 1 mm under load of 10 kgf (98N) becomes $10^4$ Pa·s ($10^5$ poise).

In the invention, as the binder resin, the crystalline resin and at least one kind of the non-crystalline resin are necessarily contained. Accordingly, when toner particles are manufactured, the crystalline resin and the non-crystalline resin are preferably simultaneously blended to use. As mentioned above, since the binder resin in the invention includes a shell in the core/shell structure, for instance, a structure in which the core contains the crystalline resin and the shell contains the non-crystalline resin may be adopted.

The crystalline resin, among components that constitute the binder resin, is preferably contained in the range of 5 to 70% by mass and more preferably in the range of 10 to 50% by mass. When a ratio of the crystalline resin exceeds 70% by mass, excellent fixing property can be obtained and the dependence on the process speed of the fixing property can be assuredly reduced. However, since the characteristics of the crystalline resin become dominant, a phase separation structure in the fixed image may become irregular, the mechanical strength of the fixed image, in particular, the scratch resistance may be deteriorated, and the bruise tends to occur.

On the other hand, when the ratio of the crystalline resin is less than 5% by mass, in some cases, the sharp-melt property derived from the crystalline resin may not be obtained and the plasticity may simply occur; accordingly, in some cases, it cannot be attained that with excellent low temperature fixing property maintaining, the toner blocking resistance and the image storage stability may not be maintained. Furthermore, since the frequency dependence of the storage elasticity of the toner, that is, the fixing speed dependence may become larger, when the fixing speed is large, the fixing property may deteriorate.

A ratio of the crystalline resin to the non-crystalline resin (the crystalline resin/the non-crystalline resin) is preferably in the range of 5/95 to 70/30 by mass ratio because this enables to satisfy the dynamic viscoelastic characteristics, and particularly preferably in the range of 10/90 to 50/50.

As the releasing agent that is used in the invention, a substance that has a peak temperature of the maximum absorption peak measured in accordance with ASTM D3418-8 in the range of 50 to 110 degrees centigrade is preferable. When the peak temperature is less than 50 degrees centigrade, in some cases, at the fixing, the offset tends to occur. Furthermore, when it exceeds 110 degrees centigrade, not only the viscosity of the releasing agent becomes higher and the fixing temperature becomes higher, but also in some cases the eluting property of the releasing agent at the oil-less fixing decreases to damage the stripping property.

The peak temperature of the maximum absorption peak is obtained as a peak position temperature of the maximum peak of at least one or more absorption peaks measured by carrying out the similar DSC measurement as that in which the DSC-7 manufactured by Perkin-Elmer Corporation is used to measure the releasing agent.

As examples of the releasing agent, low molecular weight polyolefins such as polyethylene, polypropylene, and polybutene; silicones having a softening point owing to heating; fatty acid amides such as oleic acid amide, erucic acid amide, ricinolic acid amide, and stearic acid amide; plant waxes such as carnauba wax, rice wax, chandellila wax, Japan tallow, and jojoba wax; animal wax such as bees wax; and mineral waxes or petroleum waxes such as montanic acid ester wax, ozokerite, ceresin, paraffin wax, microcrystalline wax, and Fischer-Tropsch wax can be cited, and furthermore modified ones thereof also can be used.

An amount of the releasing agent that is added is preferably in the range of 5 to 25 parts by mass to 100 parts by mass of the binder resin, and more preferably in the range of 7 to 20 parts by mass.

As a colorant in a toner according to the invention, known colorants can be used, For instance, as black pigment, carbon black, copper oxide, manganese dioxide, aniline black, activated carbon, non-magnetic ferrite, magnetite and so on can be cited.

As yellow pigments, for instance, chrome yellow, zinc yellow, yellow iron oxide, cadmium yellow, Hansa yellow, Hansa Yellow 10G, benzidine yellow G, benzidine yellow GR, threne yellow, quinoline yellow, permanent yellow NCG and son can be cited.

As orange pigments, red chrome yellow, molybdenum orange, permanent orange GTR, pyrazolone orange, Vulcan orange, benzidine orange G, indanthrene brilliant orange RK, indanthrene brilliant orange GK and so on can be cited.

As red pigments, iron oxide red, cadmium red, red lead, mercury sulfide, Watchang red, permanent red 4R, lithol red, brilliant carmine 3B, brilliant carmine 6B, DuPont oil red, pyrazolone red, rhodamine lake B, lake red C, rose Bengal, eosin red, alizarin lake and so on can be cited.

As blue pigments, iron blue, cobalt blue, alkali blue lake, Victoria blue lake, fast sky blue, indanthrene blue BC, aniline blue, ultramarine blue, chalcoil blue, methylene blue chloride, phthalocyanine blue, phthalocyanine green, malachite green oxalate and so on can be cited.

As purple pigments, manganese purple, fast violet B, methyl violet lake and so on can be cited.

As green pigments, chromium oxide, chrome green, pigment green, malachite green lake, final yellow green G and so on can be cited.

As white pigments, zinc oxide, titanium oxide, antimony white, zinc sulfide and so on can be cited.

As extender pigments, barytes, barium carbonate, clay, silica, white carbon, talc, alumina white and so on can be cited.

Furthermore, as dyes, various kinds of dyes such as basic, acidic, dispersion and direct dyes, for instance, nigrosin can be cited. A mixture thereof and one in a solid solution state can be also used.

The foregoing colorant is selected from viewpoints of the hue, color saturation, luminosity, weather resistance, OHP transmittance and dispersing property in the toner. An amount of the colorant that is added is in the range of 1 to 20 parts by mass relative to 100 parts by mass of the binder resin. When a magnetic material is used for the black colorant, different from other colorants, 30 to 100 parts by mass are added.

Furthermore, when the toner is used as a magnetic material, magnetic powder may be contained. As such magnetic powder, a substance that is magnetized in a magnetic field is used. Ferromagnetic powder such as iron, cobalt and nickel, or compounds such as ferrite and magnetite can be cited. In particular, when toner particles are obtained in an aqueous layer, the aqueous layer transferability, solubility and oxidizing property of the magnetic material have to be taken into consideration. Preferably, surface modification such as hydrophobidization can be applied beforehand.

In the invention, in order to further improve and stabilize the charging property, a charge control agent can be used. As the charge control agent, various kinds of charge control agents that are ordinarily used such as quaternary ammonium salt compounds, nigrosin compound, dyes made of aluminum, iron or chromium complex and triphenyl methane pigment can be used; however, from viewpoints of controlling the ionic strength that affects on the stability at the flocculation and unification in an emulsifying polymerization described below and reduction of the waste water contamination, a material difficult to dissolve in water is preferable.

Furthermore, in the invention, in order to improve the stability of the charging property and the fluidity, inorganic particles can be added on a surface of the toner. Examples of inorganic particles that can be added include particles of silica, alumina, titanium oxide, barium titanate, magnesium titanate, calcium titanate, strontium titanate, zinc oxide, quartz sand, clay, mica, wollastonite, diatom earth, cerium chloride, red iron oxide, chromium oxide, cerium oxide, antimony trioxide, magnesium oxide, zirconium oxide, silicon carbide, silicon nitride and so on. Among these, silica particles are preferable and hydrophobidized silica particles are particularly preferable.

An average primary particle diameter (number-average particle diameter) of the inorganic particles is preferably in the range of 1 to 1,000 nm and an amount thereof that is added (external addition) is preferably in the range of 0.01 to 20 parts by mass relative to 100 parts by mass of the toner.

When toner particles are processed in a wet method described later, one that is used as an external additive can be dispersed with an ionic surfactant, a polymer acid or a polymer base to use.

Furthermore, particles of a resin such as a vinyl resin, polyester, silicone, polystyrene, polymethyl methacrylate or polyvinylidene fluoride are added on a surface in a dry state under shear condition to use as a fluidity additive or cleaning additive.

An electrostatic latent image developing toner according to the invention, in a section observation owing to transmission electron microscope (TEM) observation, preferably has a core/shell structure as a whole. Specifically, as mentioned above, the toner particles according to the invention contain a crystalline resin as the binder resin; accordingly, a shell is preferably formed with the non-crystalline resin to inhibit the internal crystalline resin from being exposed and ensuing deterioration of the fluidity and charging property of the toner from occurring.

Accordingly, when the core/shell structure cannot be observed, although the fixing property becomes excellent, owing to the exposure of the crystalline resin, releasing agent and colorant, in some cases, the charging property and the powder characteristics may be damaged.

In the above, the toner having a core/shell structure as a whole means that, in an observation photograph of a toner section, in a periphery of the core (internal matrix particle), a shell (outer shell) having a thickness in the range of substantially 0.1 to 0.8 μm is formed so as to cover the core by 80% or more.

The TEM observation is carried out as follows.

In the beginning, as a wrapping process of the toner, 7 g of bisphenol A type liquid epoxy resin (manufactured by Asahi Chemical Industry Co., Ltd.) and 3 g of ZENAMID 250 that is a hardener (manufactured by Henkel Japan Ltd.) are mildly mixed and prepared, followed by mixing 1 g of toner and leaving to harden, and thereby a grinding sample is prepared. Subsequently, with a grinder LEICA ultramicrotome (model number: ULTRACUT UCT, manufactured by Hitachi High Technologies Corp.) provided with a diamond knife (model number: Type Cryo, manufactured by DIATOME Corp.), a wrapped sample for grinding is ground under −100 degrees centigrade to prepare an observation sample.

Furthermore, the foregoing sample is left in a desiccator under a ruthenium tetraoxide (manufactured by Soekawa Chemical Co., Ltd.) atmosphere to dye. A degree of dying is judged by visually observing a degree of dying of a simultaneously left tape. With the dyed sample, a section of the toner is observed by use of a high-resolution field emission scanning electron microscope (product name: S-4800, manufactured by Hitachi High Technologies Co., Ltd.) provided with a transmitted electron detector. At this time, an observation multiplication factor is set at 5,000 and 10,000 times.

In the foregoing TEM observation, it is preferable that, inside of the toner, in a sea structure of the non-crystalline resin, the crystalline resin crystals and the releasing agent crystals coexist as an island structure; a shape of the crystalline resin crystals is block-shaped; and a longer side length of the releasing agent crystals is in the range of 0.5 to 1.5 μm.

In the above, "in a sea structure of the non-crystalline resin, the crystalline resin crystals and the releasing agent crystals coexist as an island structure" means that in a sea structure of the non-crystalline resin, at least an island structure of crystals (crystalline resin crystals) based on the crystalline resin and an island structure of crystals (releasing agent crystals) based on the releasing agent can be separately observed.

Furthermore, "the crystalline resin crystal is block-shaped" means that an aspect ratio of a shorter side length and a longer side length in the crystalline resin crystals (shorter side/longer side) is in the range of 0.6 to 1.0. Still furthermore, "rod-shaped" described later means that the aspect ratio is in the range of 0.05 to 0.3. Still furthermore, "being block-shaped" means that 10% or more of the observed crystalline resin crystals is block-shaped.

When the crystalline resin crystals are block-shaped, at the softening/melting of the toner ensuing the fixing/heating, the elution directivity of molten crystalline resin becomes excellent, and thereby the elution property to a fixed image surface is preferably improved.

Furthermore, a size (extended side length) of the crystalline resin crystal is preferably in the range of 0.5 to 1.5 μm. When the size is less than 0.5 μm, only the compatibility with the non-crystalline resin is generated and the low temperature fixing property is surely improved. However, in some cases, an apparent Tg of the binder resin decreases and the powder characteristics and image storage stability deteriorate. On the other hand, when the size exceeds 1.5 μm, surely it is advantageous in the oil-less stripping at a complete constant temperature; however, in a system having a large temperature distribution like a fixing process of an electrophotography, it is necessary to impart a certain fluctuation in the melting property. When the size exceeds 1.5 μm, it may not be attained.

Still furthermore, a size (extended side length) in the toner of the releasing agent crystals necessary for maintaining the foregoing stripping property is important and preferably in the range of 0.5 to 1.5 μm. When it is less than 0.5 μm, at the melting during the fixing, in some cases, uniform bleeding property cannot be obtained. On the other hand, when it exceeds 1.5 μm, an un-molten portion is generated at the fixing, and thereby not only the bending resistance of a fixed image may be damaged and an image defect may be generated, but also in some cases the transparency at the OHP outputting may be unfavorably damaged.

In the TEM observation of a toner section, a shape of the releasing agent crystal present inside of the foregoing toner is preferably rod-shaped or block-shaped.

That is, when the shape of the releasing agent crystals present inside of the toner is only any one of rod-shaped and block-shaped, since a melting time period during the heating/fixing may become uniform, it is surely advantageous in the stripping of the oil-less fixing at a complete constant temperature. However, in a system having a large temperature distribution like a fixing process of an electrophotography, it is necessary to impart a certain fluctuation in the melting property. Accordingly, the coexistence of the rod-shaped crystals and the block-shaped crystals that are different in the melting property may become important for the stripping stability of the oil-less fixing.

The foregoing extended side length in the invention is the maximum length when sizes of the crystalline resin crystals or releasing agent crystals are measured with a photograph obtained in the TEM observation and an average value when 100 toner particles are measured of the length.

Here, in general, a crystalline polymer that constitutes the releasing agent, normally from a state thereof, that is, moving states of molecular chains, as a temperature goes up, undergoes phase change such as a glass region, transition region, rubber-like region and fluidizing region. Among these changes of state, the glass region is a state where a temperature is equal to or lower than the glass transition temperature (Tg) and a movement of a main chain of a polymer is frozen. However, when the temperature goes up, the movement of molecules becomes larger and the melting of crystals results. This temperature is taken as a melting point. However, even after the melting, the viscosity varies depending on the molecular weight and the molecular structure; accordingly, together with the melting point, the characteristics are also important factor for understanding the characteristics of the releasing agent.

Furthermore, the viscosity of the releasing agent largely affects on the stripping property in the fixing in an electrophotography of the oil-less toner. That is, when the toner is heated and melted in the fixing, the releasing agent present in the toner is melted and eluted to form a film between a fixing member and a toner fixed layer and thereby to secure the stripping property between the fixing member and a sheet. Accordingly, the melt viscosity of the releasing agent is very important, since it affects on the readily eluting property. Furthermore, when the releasing agent is melted, a balance with the viscoelasticity of the binder resin is important. That is, since the viscosity (viscoelasticity) of the binder resin as well varies with a temperature and the higher the temperature, the more viscous property is exhibited, it is important to establish a balance between the viscosity of the releasing agent and the viscosity of the binder resin.

Furthermore, in the invention, in a toner surface observed from a scanning electron microscope (SEM) image, pores of 200 nm or less are observed and a ratio of the pores in a toner surface area is preferably less than 20%. When a size of the pore exceeds 200 nm, since a loss when an external additive is added is large, in some cases, the charging property/fluidity may be damaged. When the ratio exceeds 20%, uneven adhesion of the external additive may be caused to unfavorably damage the charging property.

In the SEM observation, a scanning electron microscope (trade name: S-4800 manufactured by Hitachi High Technologies Co., Ltd.) is used.

A volume average particle diameter of the toner according to the invention is preferably in the range of 3 to 9 μm, and more preferably in the range of 3 to 8 μm. When the volume average particle diameter of the toner particles exceeds 9 μm, since a ratio of coarse particles becomes higher, the reproducibility of a thin line and a fine dot of an image obtained through the fixing and the gradation property may deteriorate. On the other hand, when the volume average particle diameter of the toner particles is less than 3 μm, the powder fluidity, developing property or the transferring property of the toner may deteriorate, and various inconveniences in other processes ensuing the deterioration of the powder characteristics such as the deterioration of the cleaning property of the toners remaining on a surface of an image carrier may be caused.

Furthermore, as an index of a particle size distribution of the toner particles that are used in the invention, a volume average particle size distribution index GSDv is preferably 1.30 or less and a ratio thereof to a number average particle size distribution index GSDp, GSDv/GSDp, is more preferably 0.95 or more. When the volume average particle size distribution index GSDv exceeds 1.30, the resolution may deteriorate, and when the ratio of the volume average particle size distribution index GSDv to the number average particle size distribution index GSDp, GSDv/GSDp, is less than 0.95, in some cases, the charging property may be caused to deteriorate and at the same time image defect such as scattering and fogging may be caused.

Values of the foregoing volume average particle diameter and the particle size distribution indices are calculated as follows. In the beginning, a particle size distribution of the toner measured with Coulter Counter TA II (manufactured by Beckman-Coulter Co., Ltd.) as a measurement device is divided into particle diameter ranges (channels). A volume and number of toner particles in each of the channels is depicted as a cumulative distribution from a small diameter side, particle diameters where the cumulative values become 16% are defined as a volume average particle diameter D16v and a number average particle diameter D16p, and particle diameters where the cumulative values become 50% are defined as a volume average particle diameter D50v (this value is taken as a volume average particle diameter) and a number average particle diameter D50p. Similarly, particle diameters where the cumulative values become 84% are defined as a volume average particle diameter D84v and a number average particle diameter D84p. With these values, the volume average particle diameter distribution index GSDv is defined as $(D84v/D16v)^{1/2}$, and the number average particle diameter distribution index GSDp is defined as $(D84p/D16p)^{1/2}$.

Furthermore, a shape factor SF1 of the toner in the invention is preferably in the range of 110 to 140.

When the shape factor SF1 is set in the range of 110 to 140, a coverage ratio of the shell can be readily made higher in the core/shell structure.

Now, the foregoing shape factor SF1 can be obtained according to the following formula (5).

$$SF1=(ML^2/A)\times(\pi/4)\times 100 \qquad \text{formula (5)}$$

In the foregoing formula (5), ML denotes an absolute maximum length of a toner particle and A denotes a projection area of the toner particle.

The SF1 can be quantified by analyzing mainly a microscope image or a scanning electron microscope (SEM) image by use of an image analyzer. It can be calculated, for instance, as shown below. That is, a microscope image of toner particles sprayed on a slide glass surface is taken into a LUZEX image analyzer through a video camera, the maximum length and the projection area of each of 100 or more toner particles are obtained, the SF1 is calculated according to the formula (5), followed by obtaining an average value.

The toner particles in the invention can be prepared according to any one of a kneading and pulverizing process, a suspension polymerizing process, a dissolution and suspension process, and an emulsion flocculating and uniting process; however, an emulsion-polymerization flocculation and unification process, since it can give a sharp particle size distribution and is easy in controlling a toner shape and a toner surface property (core/shell structure), is preferable as a method that can satisfy the foregoing requirement.

A process of preparing an electrostatic latent image developing toner according to the invention by means of the emulsion-polymerization flocculation process will be described later.

On the other hand, when toner particles in the invention are obtained by means of the kneading and pulverizing process, in the beginning, a resin (binder resin), a colorant, a releasing agent and so on that are described later in the emulsion-polymerization flocculation process are blended by use of a blender such as a Nauta Mixer or Henschel Mixer, followed by kneading by means of such as a uniaxial or a biaxial extruder. This is rolling-milled and cooled, followed by finely pulverizing by use of a mechanical or air pulverizer typical in an 1 type mill, KTM, and jet mill, further followed by classification with use of a classifier that uses Coanda effect such as an elbow jet or an air classifier such as a Turbo-classifier and an AccuCut. Furthermore, a dry process of planting particles of resin on a surface of the prepared toner particles may be applied.

A charge amount of the toner for developing electrostatic latent image according to the invention is preferably in the range of 20 to 40 μC/g by absolute value and more preferably in the range of 15 to 35 μC/g. When the charge amount is less than 20 μC/g, the background contamination (fogging) is likely to occur, and when it exceeds 40 μC/g, the image density tends to decrease. Furthermore, as a ratio of a charge amount of the toner for developing electrostatic latent image in summer season (high temperature and high humidity) to that in winter season (low temperature and low humidity) is preferably in the range of 0.5 to 1.5, and more preferably in the range of 0.7 to 1.3. When the ratio is outside of the range, since the environment dependence of the charging property is strong and the charging is less stable, it is unfavorable from a practical point of view.

When the foregoing respective toner characteristics are satisfied, an electrostatic latent image developing toner that can be fixed at a low temperature and is less even in a process from low speed to high speed in fluctuation in the fixed image adherence to a fixing sheet in the oil-less fixing and excellent in the blocking resistance can be obtained.

Manufacturing Method of Electrostatic Latent Image Developing Toner

A manufacturing method of an electrostatic latent image developing toner according to the invention includes mixing at least a dispersion of resin particles in which a resin containing a crystalline resin having a volume average particle diameter of 1 μm or less is dispersed, a colorant dispersion in which a colorant is dispersed, and a releasing agent dispersion in which a releasing agent is dispersed to form flocculates in the presence of an aluminum ion; and, after the flocculates are stopped in growing, heating it to melt and unite.

Such an emulsion-polymerization flocculation and unification process is preferable from a viewpoint of applying functionally separated designing as in the toner according to the invention.

Specifically, this is a method in which in general, a dispersion of resin particles in which resin particles manufactured according to an emulsion polymerizing process are dispersed by use of an ionic surfactant, a colorant dispersion obtained by dispersing by use of an ionic surfactant having the polarity opposite to that of the foregoing surfactant and so on are blended to form heteroflocculates, followed by flocculating the heteroflocculates to form flocculated particles having a toner diameter, further followed by heating to a glass transition point or higher of a non-crystalline resin that is normally contained in the flocculates to melt and unite the flocculates, still further followed by washing and drying.

In the invention, a binder resin contains a crystalline resin and a non-crystalline resin; accordingly, as resin particles crystalline resin particles and non-crystalline resin particles are prepared.

A dispersion of crystalline resin particles can be obtained by applying a known inverse emulsification or by heating to a temperature equal to or higher than the melting point and applying mechanical shear to emulsify. At this time, an ionic surfactant and so on may be added. Furthermore, the non-crystalline resin particles, though preferable to be manufactured according a process similar to a manufacturing process of the crystalline resin particles, in the case where an emulsion polymerization can be applied like in styrene-acrylic resin, are prepared by dispersing resin particles prepared according to the emulsion polymerization in a solvent by use of an ionic surfactant and so on.

Furthermore, the colorant dispersion is prepared, with an ionic surfactant having the polarity opposite to that of one used in preparing the dispersion of resin particles, by dispersing colorant particles having a desired color such as blue, red or yellow color in a solvent. Still furthermore, the dispersion of releasing agent can be prepared by dispersing a releasing agent in water together with an ionic surfactant and a polymer electrolyte such as a polymer acid or a polymer base, followed by pulverizing into particles by use of a homogenizer or a pressure discharge type disperser that can heat to a temperature equal to or more than a melting point and apply strong shear.

A particle diameter of resin particles in a dispersion of resin particles in the invention is 1 μm or less by volume average particle diameter, and preferably in the range of 100 to 300 nm. When the volume average particle diameter exceeds 1 μm, a particle size distribution of toner particles that are obtained by flocculating and melting becomes broader or free particles are generated, and the reliability of performance of the toner may deteriorate. When the volume average particle diameter is less than 100 nm, in some cases, a long time is necessary for flocculating and growing toner particles to be industrially impractical. When it exceeds 300 nm, in some cases, the releasing agent and colorant are irregularly dispersed and the surface property of toner can be controlled with difficulty.

A particle diameter of the dispersion of resin particles and so on can be measured by use of, for instance, a laser diffraction particle size distribution analyzer (trade name: LA-700 manufactured by Horiba, Ltd.).

In the flocculating, the respective particles in the dispersion of resin particles, the colorant dispersion and, as needs arise, the dispersion of releasing agent, which are mutually mixed, flocculate to form flocculated particles. The process may be carried out by mixing the respective dispersions in lump to flocculate; however, a step of adhering described below may be contained.

That is, in the flocculating, amounts of initial ionic dispersants of the respective polarities are beforehand set off-balance, this is ionically neutralized with a polymer of an inorganic metal salt such as aluminum polychloride, after forming and stabilizing first stage matrix flocculates at a temperature equal to or less than the glass transition point, as a second stage, a dispersion of resin particles which are processed with a dispersant having the polarity and an amount that compensate the deviation from the balance is added, furthermore, as needs arise, followed by heating at a temperature slightly lower than the glass transition temperature of resin particles of the resin that is contained in a matrix or additional particles, further followed by heating at a higher temperature to stabilize to form adhesion particles (adhering). Subsequently, with the resin particles added in the second stage of the flocculating by heating to a temperature equal to or higher than the glass transition temperature adhered on a surface of matrix-flocculated particles, uniting is applied. Furthermore, a step-wise operation of the flocculating may be repeated by a plurality of times.

In the invention, as mentioned above, as a structure of the toner, a core/shell structure is preferable, and toner particles having such a structure can be preferably prepared according to an emulsion-polymerization flocculation and unification process having the foregoing adhering.

Accordingly, the following process will be described with a focus on a manufacturing method of toner having a core/shell structure prepared containing the adhering.

In the flocculating, it is necessary that the respective dispersions are mixed in the presence of an aluminum ion to form flocculated particles. As at least one kind of a polymer of metal salt that is added with this intention, the polymer of a metal salt is preferably a polymer of tetravalent aluminum salt or a mixture of a polymer of tetravalent aluminum salt and a polymer of trivalent aluminum salt. Specific examples of the polymer include a polymer of an inorganic metal salt such as aluminum sulfate or a polymer of an inorganic metal salt such as aluminum polychloride. Furthermore, these polymers of metal salt are preferably added so that a concentration thereof may be in the range of 0.11 to 0.25% by mass.

The flocculating preferably includes at least a first flocculating where a dispersion of resin particles in which crystalline resin particles having a volume average particle diameter of 1 μm or less and non-crystalline particles are dispersed, a colorant dispersion where colorant particles are dispersed and a releasing agent dispersion where releasing agent particles are dispersed are mixed to form core-flocculated particles containing the crystalline resin particles and non-crystalline resin particles, the colorant particles, and the releasing agent particles; and a second flocculating where on a surface of the core-flocculated particles a shell layer containing second resin particles is formed to obtain flocculated particles having a core/shell structure.

In the first flocculating, in the beginning, a dispersion of crystalline resin particles and non-crystalline resin particles, a dispersion of colorant particles and a dispersion of releasing agent particles are prepared. However, when in the invention, particles of a non-crystalline resin are used as second resin particles for forming the shell layer, in the first flocculating, only particles of crystalline resin may be used.

In the next place, the dispersion of crystalline resin particles and non-crystalline resin particles, the colorant dispersion and the releasing agent dispersion are mixed to allow the resin particles, colorant particles and releasing agent particles to undergo hetero-flocculation to form flocculated particles (core-flocculated particles) having a diameter substantially equal to a desired toner diameter.

Furthermore, on a surface of the core-flocculated particle, with a resin particle dispersion containing non-crystalline resin particles, the non-crystalline resin particles are adhered to form a covered layer (shell layer) having a desired thickness, and thereby flocculated particles (core/shell aggregate) that have a core/shell structure having a shell layer on a surface of the core-flocculated particle can be obtained.

In the invention, examples of surfactants that are used to disperse, flocculate or stabilize the resin, colorant and releasing agent include anionic surfactants such as sulfate ester salt-based, sulfonate-based, phosphate ester salt-based, and soap-based anionic surfactants; cationic surfactants such as amine salt type and quaternary ammonium salt type cationic surfactant; polyethylene glycol-based one; and alkyl phenol ethylene oxide adduct-based one. A polyhydric alcohol-based nonionic surfactant can be effectively combined. As a device for dispersing, one that can be generally used such as a rotary shear homogenizer, and a ball mill, sand mill, dyno mill and so on which use media can be cited.

Subsequently, an atmosphere of the flocculated particles is preferably adjusted so as to be 6 to 10 in the pH to stop the flocculated particles from growing, followed by, in the melting and unifying, heating the core/shell flocculated particles obtained through the flocculating process, in a solution, to the highest temperature among a melting point of the crystalline resin contained in the core/shell flocculated particle and a glass transition point (when there are two or more kinds of resins, the glass transition point of a resin having the highest glass transition point) of the non-crystalline resin particles (containing a resin constituting a shell layer structure) to melt and unify, and thereby a toner is formed.

After the foregoing flocculating and melting process, by optionally undergoing washing, solid/liquid separating and drying, a desired toner is obtained. In the washing, from a viewpoint of the charging property, displacement washing with ion-exchange water is preferably sufficiently applied. Furthermore, in the solid/liquid separating, though not particularly restricted, from a viewpoint of the productivity, suction filtering and pressure filtering are preferably used. Still furthermore, the drying is neither particularly restricted. However, from a viewpoint of the productivity, freeze-drying, flash-jet drying, fluidized drying and vibration fluidized drying and so on can be preferably used.

The toner for developing electrostatic latent image according to the invention can be manufactured by preparing toner particles (matrix particles) as mentioned above, followed by adding the foregoing inorganic particles to the toner, further followed by mixing by use of a Henschel mixer and so on.

As a manufacturing method of the toner for developing electrostatic latent image according to the invention, the description was focused on the manufacturing method of the toner having the core/shell structure. However, the invention is not restricted thereto. Even when toner particles do not have a shell layer, there is no problem as far as the toner satisfies the foregoing characteristics.

EXAMPLE

In what follows, the invention will be described with reference to examples. However, the invention is not restricted to the examples. In the description below, as far as not particularly stated, "parts" and "%" all mean "parts by mass" and "% by mass".

Preparation of Toner

A toner in an example can be obtained according to a process mentioned below.

That is, at least a dispersion of non-crystalline resin particles having a volume average particle diameter of 1 μm or less and/or a dispersion of crystalline resin particles are mixed at a particular ratio, followed by mixing thereto a colorant dispersion and a releasing agent dispersion, further followed by flocculating and growing with at least one kind of metal salt including aluminum polychloride at a temperature in the range of 45 to 65 degrees centigrade. Subsequently, thereto, non-crystalline resin particles same as or different from those that are used in the flocculating are added again to form a shell layer (adhering).

Thereafter, the pH of an atmosphere where flocculated particles exist is maintained in the range of 6.0 to 10.0 to stop the flocculated particles from growing, followed by heating to a temperature equal to or more than the glass transition temperature or the melting point of the resin to melt and unite until a toner surface is fused, further followed by cooling to a temperature equal to or less than 40 degrees centigrade, and thereby a toner is obtained. The step-wise operations of the flocculating and adhering may be repeated a plurality of times. Subsequently, by appropriately applying the washing and drying, a desired toner can be obtained.

In what follows, processes of preparing the respective dispersions and an example of manufacture of toner will be described.

(Synthesis of the Respective Resin Materials)

-Crystalline Polyester Resin-

Into a heated and dried three-mouthed flask, 160.0 parts of 1, 10-decanediol, 40.0 parts of dimethyl sodium 5-sulfoisophthalate, 8 parts of dimethyl sulfoxide and 0.02 parts of dibutyltin oxide as a catalyst are poured, followed by depressurizing air in a vessel and introducing nitrogen to render an inert atmosphere, further followed by mechanically agitating at 180 degrees centigrade for 3 hr. Thereafter, under reduced pressure, dimethyl sulfoxide is distilled, and, under flow of nitrogen, 23.0 parts of dimethyl dodecane dioic acid is added followed by agitating at 180 degrees centigrade for 1 hr.

Thereafter, the temperature is gradually increased to 220 degrees centigrade under reduced pressure, followed by stirring for 30 min. When the mixture becomes a viscous state, the mixture is cooled by air and the reaction is stopped. Thereby, 360 parts of a crystalline polyester resin is synthesized.

The weight average molecular weight (Mw) of the crystalline polyester resin, which is obtained by a molecular weight measurement according to gel permeation chromatography (polystyrene conversion), is 24,200, and the number average molecular weight (Mn) thereof is 8,900. Furthermore, the melting point (Tm) of the crystalline polyester resin is measured with a differential scanning calorimeter (DSC) in accordance with the aforementioned measuring method. The melting point has a clear peak and the peak top temperature is 73 degrees centigrade.

-Non-Crystalline Polyester Resin (1)-

| | |
|---|---|
| Dimethyl naphthalene dicarboxylate | 122 parts |
| Dimethyl terephthalate | 97 parts |
| Bisphenol A - ethylene oxide adduct | 221 parts |
| Ethylene glycol | 70 parts |
| Tetrabutoxy titanate | 0.07 parts |

Into a heated and dried three-mouthed flask, the foregoing respective components are poured, followed by heating at a temperature in the range of 170 to 220 degrees centigrade for 180 min to carry out an ester exchange reaction. Subsequently, at 220 degrees centigrade, the pressure of a system is set in the range of 133.3 to 1,333 Pa (1 to 10 mm Hg), followed by continuing the reaction for 60 min, and thereby a non-crystalline polyester resin (1) is obtained. The glass transition point of the non-crystalline polyester resin (1) is 79 degrees centigrade.

-Non-Crystalline Polyester Resin (2)-

| | |
|---|---|
| Dimethyl terephthalate | 97 parts |
| Dimethyl isophthalate | 97 parts |
| Bisphenol A - ethylene oxide adduct | 158 parts |
| Ethylene glycol | 100 parts |
| Tetrabutoxy titanate | 0.07 parts |

Into a heated and dried three-mouthed flask, the foregoing respective components are poured, followed by heating at a temperature in the range of 170 to 220 degrees centigrade for 180 min to carry out an ester exchange reaction. Subsequently, at 220 degrees centigrade, the pressure of a system is set in the range of 133.3 to 1,333 Pa (1 to 10 mm Hg), followed by continuing the reaction for 60 min, and thereby a non-crystalline polyester resin (2) is obtained. The glass transition point of the non-crystalline polyester resin (2) is 54 degrees centigrade.

-Non-Crystalline Polyester Resin (3)-

| | |
|---|---|
| Dimethyl terephthalate | 58 parts |
| Dimethyl isophthalate | 78 parts |
| Succinic acid anhydride | 30 parts |
| Bisphenol A - ethylene oxide adduct | 158 parts |
| Ethylene glycol | 100 parts |
| Tetrabutoxy titanate | 0.07 parts |

Into a heated and dried three-mouthed flask, the foregoing respective components are poured, followed by heating at a temperature in the range of 170 to 220 degrees centigrade for 180 min to carry out an ester exchange reaction. Subsequently, at 220 degrees centigrade, the pressure of a system is set in the range of 133.3 to 1,333 Pa (1 to 10 mm Hg), followed by continuing the reaction for 60 min, and thereby a non-crystalline polyester resin (3) is obtained. The glass transition point of the non-crystalline polyester resin (3) is 48 degrees centigrade.

-Non-Crystalline Polyester Resin (4)-

| | |
|---|---|
| Dimethyl naphthalene dicarboxylate | 146 parts |
| Dimethyl terephthalate | 78 parts |

-continued

| | |
|---|---|
| Bisphenol A - ethylene oxide adduct | 221 parts |
| Ethylene glycol | 70 parts |
| Tetrabutoxy titanate | 0.07 parts |

Into a heated and dried three-mouthed flask, the foregoing respective components are poured, followed by heating at a temperature in the range of 170 to 220 degrees centigrade for 180 min to carry out an ester exchange reaction. Subsequently, at 220 degrees centigrade, the pressure of a system is set in the range of 133.3 to 1,333 Pa (1 to 10 mm Hg), followed by continuing the reaction for 60 min, and thereby a non-crystalline polyester resin (4) is obtained. The glass transition point of the non-crystalline polyester resin (4) is 82 degrees centigrade.

(Preparation of Dispersion of Resin Particles)

-Dispersion of Resin Particles (1)-

| | |
|---|---|
| Crystalline polyester resin | 115 parts |
| Ionic surfactant (trade name: Neogen RK, manufactured by Dai-ichi Kogyo Seiyaku Co., Ltd.) | 5 parts |
| Ion exchange water | 180 parts or more |

The foregoing materials are mixed and heated at 100 degrees centigrade, followed by thoroughly dispersing by use of a homogenizer (trade name: Ultra-Turrax T-50, manufactured by IKA KK), further followed by dispersing by use of a pressure discharge type Gaulin Homogenizer for 1 hr, and thereby a dispersion of resin particles (1) having a volume average particle diameter of 230 nm and a solid content of 40% is obtained.

-Dispersion of Resin Particles (2)-

| | |
|---|---|
| Non-crystalline polyester resin (1) | 115 parts |
| Ionic surfactant (trade name: Dowfax 2K1, manufactured by Dow Chemical Co., Ltd.) | 5 parts |
| Ion exchange water | 180 parts or more |

The foregoing materials are mixed and heated at 180 degrees centigrade, followed by thoroughly dispersing by use of a homogenizer (trade name: Ultra-Turrax T-50, manufactured by IKA KK), further followed by dispersing by use of a pressure discharge type Gaulin Homogenizer for 1 hr, and thereby a dispersion of resin particles (2) having a volume average particle diameter of 200 nm and a solid content of 40% is obtained.

-Dispersion of Resin Particles (3)-

| | |
|---|---|
| Non-crystalline polyester resin (2) | 115 parts |
| Ionic surfactant (trade name: Dowfax 2K1, manufactured by Dow Chemical Co., Ltd.) | 5 parts |
| Ion exchange water | 180 parts or more |

The foregoing materials are mixed and heated at 180 degrees centigrade, followed by thoroughly dispersing by use of a homogenizer (trade name: Ultra-Turrax T-50, manufactured by IKA KK), further followed by dispersing by use of a pressure discharge type Gaulin Homogenizer for 1 hr, and thereby a dispersion of resin particles (3) having a volume average particle diameter of 220 nm and a solid content of 40% is obtained.

-Dispersion of Resin Particles (4)-

| | |
|---|---|
| Non-crystalline polyester resin (3) | 115 parts |
| Ionic surfactant (trade name: Dowfax 2K1, manufactured by Dow Chemical Co., Ltd.) | 5 parts |
| Ion exchange water | 180 parts or more |

The foregoing materials are mixed and heated at 180 degrees centigrade, followed by thoroughly dispersing by use of a homogenizer (trade name: Ultra-Turrax T-50, manufactured by IKA KK), further followed by dispersing by use of a pressure discharge type Gaulin Homogenizer for 1 hr, and thereby a dispersion of resin particles (4) having a volume average particle diameter of 250 nm and a solid content of 40% is obtained.

-Dispersion of Resin Particles (5)-

| | |
|---|---|
| Non-crystalline polyester resin (4) | 115 parts |
| Ionic surfactant (Neogen RK, manufactured by Dai-ichi Kogyo Seiyaku Co., Ltd.) | 5 parts |
| Ion exchange water | 180 parts or more |

The foregoing materials are mixed and heated at 180 degrees centigrade, followed by thoroughly dispersing by use of a homogenizer (trade name: Ultra-Turrax T-50, manufactured by IKA KK), further followed by dispersing by use of a pressure discharge type Gaulin Homogenizer for 1 hr, and thereby a dispersion of resin particles (5) having a volume average particle diameter of 200 nm and a solid content of 40% is obtained.

-Dispersion of Resin Particles (6)-

| | |
|---|---|
| Crystalline polyester resin | 23 parts |
| Non-crystalline polyester resin (1) | 92 parts |
| Ionic surfactant (Neogen RK, manufactured by Dai-ichi Kogyo Seiyaku Co., Ltd.) | 5 parts |
| Ion exchange water | 180 parts or more |

The foregoing materials are mixed and heated at 180 degrees centigrade, followed by thoroughly dispersing by use of a homogenizer (trade name: Ultra-Turrax T-50, manufactured by IKA KK), further followed by dispersing by use of a pressure discharge type Gaulin Homogenizer for 1 hr and thereby a dispersion of resin particles (6) having a volume average particle diameter of 190 nm and a solid content of 40% is obtained.

-(Preparation of Colorant Dispersion)-

| | |
|---|---|
| Cyan pigment (trade name: copper phthalocyanine B-15: 3, manufactured by Dainichiseika Color & Chemicals Mfg. Co., Ltd.) | 45 parts |
| Ionic surfactant (Neogen RK, manufactured by Dai-ichi Kogyo Seiyaku Co., Ltd.) | 5 parts |
| Ion exchange water | 200 parts |

The foregoing materials are mixed and dissolved, followed by dispersing with a homogenizer (trade name: Ultra-Turrax T-50, manufactured by IKA KK) for 10 min, and thereby a colorant dispersion having a volume average particle diameter of 138 nm is obtained.

(Preparation of Releasing Agent Dispersion)

| | |
|---|---|
| Paraffin Wax HNP9 (melting point: 68° C., manufactured by Nihon Seirou Co., Ltd.) | 45 parts |
| Cationic surfactant (Neogen RK, manufactured by Dai-ichi Kogyo Seiyaku Co., Ltd.) | 5 parts |
| Ion exchange water | 200 parts |

The foregoing materials are mixed and heated at 60 degrees centigrade, followed by thoroughly dispersing by use of a homogenizer (trade name: Ultra-Turrax T-50, manufactured by IKA KK), further followed by dispersing by use of a pressure discharge type Gaulin Homogenizer, and thereby a releasing agent dispersion having a volume average particle diameter of 190 nm and a solid content of 25% is obtained.

(Preparation of Toner Particles)

With materials prepared as mentioned above, according to an emulsion flocculation and unification process, toner particles are prepared.

-Toner Particles 1-

| | |
|---|---|
| Dispersion of resin particles (1) | 20 parts |
| Dispersion of resin particles (2) | 60 parts |
| Colorant dispersion | 60 parts |
| Releasing agent dispersion | 60 parts |
| Aluminum polychloride | 0.41 parts |

The foregoing respective components are poured into a round stainless steel flask, followed by thoroughly mixing and dispersing with Ultra-Turrax T-50. In the next place, 0.40 parts of aluminum polychloride is added, followed by continuing to disperse by use of the Ultra-Turrax T-50. The flask, while heating to 47 degrees centigrade with a heating oil-bath under agitation, is kept at this temperature for 60 min, followed by slowly adding thereto 31 parts of the dispersion of resin particles (2). Thereafter, a 0.5 mol/L sodium hydroxide aqueous solution is added to control the pH in the system at 10.0, followed by closely sealing the stainless flask, further followed by heating, while continuing to mix by use of a magnetic seal, up to 96 degrees centigrade and holding for 5 hr.

After the reaction comes to completion, the mixture is cooled, filtered and thoroughly washed with ion-exchange water, followed by applying solid/liquid separation by use of a Nutsche suction filter. This is further dispersed at 40 degrees centigrade in 3 L of ion exchange water, followed by agitating and washing at 300 rpm for 15 min. The process is further repeated by 5 times. A filtrate, when the pH, electrical conductivity and surface tension thereof, respectively, become 7.01, 9.8 μS/cm and 71.1 Nm, is subjected, by use of a Nutsche suction filter, to the solid/liquid separation with No. 5A filter paper. Subsequently, vacuum drying is continued for 12 hr to obtain toner particles 1.

A particle size distribution of the toner particles 1 is measured with a Coulter Counter TA II (manufactured by Beckman-Coulter Co., Ltd.) and a volume average particle diameter and a volume average particle size distribution index GSDv, respectively, are found to be 6.3 μm and 1.25.

Furthermore, the shape factor SF1 of particles obtained from shape observation by use of a LUZEX image analyzer is 132.8, that is, potato-shaped.

Furthermore, in an observation with a transmission electron microscope (TEM), toner particles as a whole are observed to have a core/shell structure, and it is confirmed that inside of a core in a sea structure of a non-crystalline resin crystalline resin crystals and releasing agent crystals coexist. A shape of the crystalline resin crystal is block-shaped and an extended side length of the releasing agent crystal is 0.6 μm.

-Toner Particles 2-

Except that initial addition amounts of the dispersion of resin particles (1) and the dispersion of resin particles (2) are set at 9 parts and 71 parts, respectively, similarly to the toner particles 1, toner particles 2 are prepared.

A particle size distribution of the toner particles 2 is measured with a Coulter Counter TA II and a volume average particle diameter and a volume average particle size distribution index GSDv, respectively, are found to be 6.1 μm and 1.21. Furthermore, the shape factor SF1 of particles obtained from shape observation by use of a LUZEX image analyzer is 128.1, that is, potato-shaped.

Furthermore, in an observation with a transmission electron microscope (TEM), toner particles as a whole are observed to have a core/shell structure, and it is confirmed that inside of a core in a sea structure of a non-crystalline resin crystalline resin crystals and releasing agent crystals coexist. A shape of the crystalline resin crystal is block-shaped and an extended side length of the releasing agent crystal is 1.3 μm.

-Toner Particles 3-

Except that initial addition amounts of the dispersion of resin particles (1) and the dispersion of resin particles (2) are set at 38 parts and 42 parts, respectively, similarly to the toner particles 1, toner particles 3 are prepared.

A particle size distribution of the toner particles 3 is measured with a Coulter Counter TA II and a volume average particle diameter and a volume average particle size distribution index GSDv, respectively, are found to be 6.1 μm and 1.21. Furthermore, the shape factor SF1 of particles obtained from shape observation by use of a LUZEX image analyzer is 128.1, that is, potato-shaped.

Furthermore, in an observation with a transmission electron microscope (TEM), toner particles as a whole are observed to have a core/shell structure, and it is confirmed that inside of a core in a sea structure of a non-crystalline resin crystalline resin crystals and releasing agent crystals coexist. A shape of the crystalline resin crystal is block-shaped and an extended side length of the releasing agent crystal is 0.8 μm.

-Toner Particles 4-

Except that in place of the dispersion of resin particles (1) and the dispersion of resin particles (2), 40 parts of the dispersion of resin particles (6) is used and in the middle 31 parts of the dispersion of resin particles (2) is added, similarly to the toner particles 1, toner particles 4 are prepared.

A particle size distribution of the toner particles 4 is measured with a Coulter Counter TA II and a volume average particle diameter and a volume average particle size distribution index GSDv, respectively, are found to be 5.8 μm and 1.24. Furthermore, the shape factor SF1 of particles obtained from shape observation by use of a LUZEX image analyzer is 128.1, that is, potato-shaped.

Furthermore, in an observation with a transmission electron microscope (TEM), toner particles as a whole are observed to have a core/shell structure, and it is confirmed that inside of a toner particle in a sea structure of a non-crystalline resin crystalline resin crystals and releasing agent crystals coexist. A shape of the crystalline resin crystal is block-shaped and an extended side length of the releasing agent crystal is 0.9 μm.

-Toner Particles 5-

Except that in place of the dispersion of resin particles (2), the dispersion of resin particles (3) is used, similarly to the toner particles 1, toner particles 5 are prepared.

A particle size distribution of the toner particles 5 is measured with a Coulter Counter TA II and a volume average particle diameter and a volume average particle size distribution index GSDv, respectively, are found to be 5.9 μm and 1.25. Furthermore, the shape factor SF1 of particles obtained from shape observation by use of a LUZEX image analyzer is 132.5, that is, potato-shaped.

Furthermore, in an observation with a transmission electron microscope (TEM), toner particles as a whole are observed to have a core/shell structure, and it is confirmed that inside of a core in a sea structure of a non-crystalline resin crystalline resin crystals and releasing agent crystals coexist. A shape of the crystalline resin crystal is block-shaped and an extended side length of the releasing agent crystal is 0.3 μm.

-Toner Particles 6-

Except that in place of the dispersion of resin particles (1), the dispersion of resin particles (4) is used, similarly to the toner particles 1, toner particles 6 are prepared.

A particle size distribution of the toner particles 6is measured with a Coulter Counter TA II and a volume average particle diameter and a volume average particle size distribution index GSDv, respectively, are found to be 5.8 μm and 1.25. Furthermore, the shape factor SF1 of particles obtained from shape observation by use of a LUZEX image analyzer is 132.5, that is, potato-shaped.

Furthermore, in an observation with a transmission electron microscope (TEM), toner particles as a whole are observed to have a core/shell structure, and it is confirmed that inside of a core in a sea structure of a non-crystalline resin crystalline resin crystals and releasing agent crystals coexist. A shape of the crystalline resin crystal is block-shaped and an extended side length of the releasing agent crystal is 1.6 μm.

-Toner Particles 7-

Except that in place of the dispersion of resin particles (1) and the dispersion of resin particles (2), 60 parts of the dispersion of resin particles (1) is used and in the middle 31 parts of the dispersion of resin particles (2) is added, similarly to the toner particles 1, toner particles 7 are prepared.

A particle size distribution of the toner particles 7 is measured with a Coulter Counter TA II and a volume average particle diameter and a volume average particle size distribution index GSDv, respectively, are found to be 7.5 μm and 1.23. Furthermore, the shape factor SF1 of particles obtained from shape observation by use of a LUZEX image analyzer is 126.0, that is, potato-shaped.

Furthermore, in an observation with a transmission electron microscope (TEM), toner particles as a whole are observed to have a core/shell structure, and it is confirmed that inside of a core in a sea structure of a crystalline resin rod-shaped and block-shaped releasing agent crystals mingle. An extended side length of the releasing agent crystal is 1.9 μm.

-Toner Particles 8-

Except that in place of the dispersion of resin particles (1) and the dispersion of resin particles (2), 60 parts of the dispersion of resin particles (1) alone is used without additionally adding resin particles in the middle, similarly to the toner particles 1, toner particles 8 are prepared.

A particle size distribution of the toner particles 8 is measured with a Coulter Counter TA II and a volume average particle diameter and a volume average particle size distribution index GSDv, respectively, are found to be 9.3 μm and 1.34. Furthermore, the shape factor SF1 of particles obtained from shape observation by use of a LUZEX image analyzer is 120, that is, spherical.

Furthermore, in an observation with a transmission electron microscope (TEM), toner particles as a whole are not observed to have a core/shell structure. Furthermore, it is confirmed that inside of a toner in a sea structure of a crystalline resin rod-shaped and block-shaped releasing agent crystals mingle. An extended side length of the releasing agent crystal is 1.9 μm.

-Toner Particles 9-

Except that in place of the dispersion of resin particles (1) and the dispersion of resin particles (2), 60 parts of the dispersion of resin particles (5) is used without adding resin particles in the middle, similarly to the toner particles 1, toner particles 9 are prepared.

A particle size distribution of the toner particles 9 is measured with a Coulter Counter TA II and a volume average particle diameter and a volume average particle size distribution index GSDv, respectively, are found to be 6.0 μm and 1.22. Furthermore, the shape factor SF1 of particles obtained from shape observation by use of a LUZEX image analyzer is 145.0, that is, amorphous.

Furthermore, in an observation with a transmission electron microscope (TEM), toner particles as a whole are not observed to have a core/shell structure. Furthermore, it is confirmed that inside of the toner in a sea structure of a non-crystalline resin rod-shaped and block-shaped releasing agent mingle. An extended side length of the releasing agent crystal is 0.4 μm Preparation of Toner and Developer To 50 parts of each of thus prepared toner particles 1 through 9, 1.0 parts of hydrophobic silica (trade name: TS 720, manufactured by Cabbot Corp.) is added, followed by blending by use of a sample mill at 10,000 rpm for 30 sec, and thereby toners 1 through 9 are prepared. Furthermore, each of these is weighed so that a toner concentration may be 5% to a ferrite carrier that is coated with 1% of polymethacrylate (manufactured by Soken Chemical & Engineering Co., Ltd.) and has a volume average particle diameter of 50 μm, followed by agitating by use of a ball mill for 5 min to mix, and thereby developers 1 through 9 are prepared.

Example 1

With a modified model of a color copy machine DocuCentre Color 500 (trade name, manufactured by Fuji Xerox Co., Ltd. and specified to oil-less fixing) as an image former, the developer 1(containing the toner particles 1) is charged thereto and a toner amount is controlled to 15.0 g/m$^2$ and an image is output. Thereafter, by use of a fixing device of high-speed/low voltage/low power belt-nip system, with a nip width set at 6.5 mm, a fixing temperature at 140 degrees centigrade, and fixing speeds set at 50, 100, 200, 300 and 400 mm/sec, respectively, fixing tests are carried out. As sheet, J sheet manufactured by Fuji Xerox Co., Ltd. is used.

The stripping property from the fixing device is excellent in all fixing speeds and the offset is not at all caused. Furthermore, when a fixed image is folded into two and expanded again, an image defect is not observed.

Furthermore, by use of the developer, with a process speed set at 200 mm/s and a sheet changed to ST sheet manufactured by Fuji Xerox Co., Ltd., a solid image is printed on one side with a toner amount set at 15 g/m$^2$ and a 50% half tone image is printed on the other side with a toner amount set at 3.5 g/m$^2$. When the image is placed on a horizontal plate with the solid image surface held upward under the conditions of 25 degrees centigrade and 50% RH and the curl is measured with a scale, a slight but not problematic curl is found.

Still furthermore, the toner used is put in an oven set at 60 degrees centigrade, left for 24 hr, followed by naturally cooling to room temperature, and the flocculating property of the toner was measured. As a result, it is confirmed that the flocculated particle is not at all observed and excellent powder fluidity is exhibited.

The minimum value of the relaxation elasticity H in the relaxation spectrum obtained from the frequency dependence of the dynamic viscoelasticity measurement of the toner contained in the developer is 10 Pa/cm$^2$ and the relaxation time $\lambda$ is 8,200 sec. Furthermore, the gradient K of the frequency dispersion curve of the storage elasticity at 60 degrees centigrade is 0.52 Pa/cm$^{2\cdot}$° C.

Example 2

Except that in place of the developer 1 a developer 2 (containing toner particles 2) is used, similarly to example 1, the fixing test is carried out.

At this time, the cold offset is not at all detected at the all process speeds. However, it is confirmed that under a process speed condition of 400 mm/sec, the stripping property from the fixing device is slightly deteriorated. Accordingly, though not problematic, there is fear that the cold offset may be caused to the process speed.

Furthermore, when the developer is measured similarly to example 1 of the curl of the image, there is no curl observed. Still furthermore, when the toner used is measured, according to a method similar to example 1, of the flocculating property of the toner, it is confirmed that there is observed no flocculate and excellent powder fluidity is exhibited.

The minimum value of the relaxation elasticity H in the relaxation spectrum obtained from the frequency dependence of the dynamic viscoelasticity measurement of the toner contained in the developer is 890 Pa/cm$^2$ and the relaxation time $\lambda$ is 1,000 sec. Furthermore, the gradient K of the frequency dispersion curve of the storage elasticity at 60 degrees centigrade is 0.86 Pa/cm$^{2\cdot}$° C.

Example 3

Except that in place of the developer 1 a developer 3 (containing toner particles 3) is used, similarly to example 1, a fixing test is carried out.

At this time, it is confirmed that the stripping property from the fixing device is excellent in all fixing speeds and there is no resistance in the stripping, and the cold offset is neither detected. Furthermore, when the developer is measured similarly to example 1 of the curl of the image, there is observed no curl. Still furthermore, when the toner used is measured, according to a method similar to example 1, of the flocculating property thereof, there is observed no flocculate; that is, it is confirmed that excellent powder fluidity is exhibited.

The minimum value of the relaxation elasticity H in the relaxation spectrum obtained from the frequency dependence of the dynamic viscoelasticity measurement of the toner contained in the developer is 370 Pa/cm$^2$ and the relaxation time $\lambda$ is 2 sec. Furthermore, the gradient K of the frequency dispersion curve of the storage elasticity at 60 degrees centigrade is 0.13 Pa/cm$^2$·° C.

Example 4

Except that in place of the developer 1 a developer 4 (containing toner particles 4) is used, similarly to example 1, a fixing test is carried out.

At this time, it is confirmed that the stripping property from the fixing device is excellent in all fixing speeds and there is no resistance in the stripping, and the cold offset is neither detected. Furthermore, when the developer is measured similarly to example 1 of the curl of the image, there is observed no curl. Still furthermore, when the toner used is measured, according to a method similar to example 1, of the flocculating property thereof, there is observed no flocculate; that is, it is confirmed that excellent powder fluidity is exhibited.

The minimum value of the relaxation elasticity H in the relaxation spectrum obtained from the frequency dependence of the dynamic viscoelasticity measurement of the toner contained in the developer is 760 Pa/cm$^2$ and the relaxation time $\lambda$ is 6,700 sec. Furthermore, the gradient K of the frequency dispersion curve of the storage elasticity at 60 degrees centigrade is 0.70 Pa/cm$^2$·° C.

Example 5

Except that in place of the developer 1 a developer 7 (containing toner particles 7) is used, similarly to example 1, a fixing test is carried out.

At this time, it is confirmed that the stripping property from the fixing device is excellent in all fixing speeds and there is no resistance in the stripping, and the cold offset is neither detected. Furthermore, when the developer is measured similarly to example 1 of the curl of the image, there is detected only slight but not problematic curl. Still furthermore, when the toner used is measured, according to a method similar to example 1, of the flocculating property thereof, there is observed no flocculate; that is, it is confirmed that excellent powder fluidity is exhibited.

The minimum value of the relaxation elasticity H in the relaxation spectrum obtained from the frequency dependence of the dynamic viscoelasticity measurement of the toner contained in the developer is 13 Pa/cm$^2$ and the relaxation time $\lambda$ is 9,900 sec. Furthermore, the gradient K of the frequency dispersion curve of the storage elasticity at 60 degrees centigrade is 0.70 Pa/cm$^2$·° C.

Comparative Example 1

Except that in place of the developer 1 a developer 6 (containing toner particles 6) is used, similarly to example 1, a fixing test is carried out.

At this time, there is caused no cold offset from the fixing device; however, the fixing strength of a fixed image, in a region where the fixing speed is larger than 200 mm/sec, is insufficient to exhibit image defect at a fold.

Furthermore, when the developer is measured similarly to example 1 of the curl of the image, the curl is 5 mm. Still furthermore, when the toner used is measured, according to a method similar to example 1, of the flocculating property thereof, there is observed no flocculate; that is, it is confirmed that excellent powder fluidity is exhibited.

The minimum value of the relaxation elasticity H in the relaxation spectrum obtained from the frequency dependence of the dynamic viscoelasticity measurement of the toner contained in the developer is 8 Pa/cm$^2$ and the relaxation time $\lambda$ is 0.08 sec. Furthermore, the gradient K of the frequency dispersion curve of the storage elasticity at 60 degrees centigrade is 0.89 Pa/cm$^2$·° C.

Comparative Example 2

Except that in place of the developer 1 a developer 5 (containing toner particles 5) is used, similarly to example 1, a fixing test is carried out.

At this time, the stripping property from the fixing device is excellent when the fixing speed is 200 mm/s or less; however, when the fixing speed exceeds this value, the cold offset is generated. Furthermore, at the fixing speed of 50 mm/sec, the fixing fault and hot offset are caused.

Furthermore, when the developer is measured similarly to example 1 of the curl of the image, the curl is such large as 12 mm. Still furthermore, when the toner used is measured, according to a method similar to example 1, of the flocculating property thereof, there is observed no flocculate; that is, it is confirmed that excellent powder fluidity is exhibited.

The minimum value of the relaxation elasticity H in the relaxation spectrum obtained from the frequency dependence of the dynamic viscoelasticity measurement of the toner contained in the developer is 930 Pa/cm$^2$ and the relaxation time $\lambda$ is 0.09 sec. Furthermore, the gradient K of the frequency dispersion curve of the storage elasticity at 60 degrees centigrade is 0.10 Pa/cm$^2$·° C.

Comparative Example 3

Except that in place of the developer 1 a developer 8 (containing toner particles 8) is used, similarly to example 1, a fixing test is carried out.

At this time, there is no problem of the stripping property from the fixing device and the clod offset is not confirmed; however, as to the fixing strength of a fixed image, under the fixing speed of 400 mm/s, image defect is observed.

Furthermore, when the developer is measured similarly to example 1 of the curl of the image, the curl is such large as 15 mm. Still furthermore, when the toner used is measured, according to a method similar to example 1, of the flocculating property thereof, there is observed no flocculate; that is, it is confirmed that excellent powder fluidity is exhibited.

The minimum value of the relaxation elasticity H in the relaxation spectrum obtained from the frequency dependence of the dynamic viscoelasticity measurement of the toner contained in the developer is 0.05 Pa/cm$^2$ and the relaxation time $\lambda$ is 12,000 sec. Furthermore, the gradient K of the frequency dispersion curve of the storage elasticity at 60 degrees centigrade is 0.09 Pa/cm$^2$·° C.

Comparative Example 4

Except that in place of the developer 1 a developer 9 (containing toner particles 9) is used, similarly to example 1, a fixing test is carried out.

At this time, the stripping property from the fixing device is excellent when the fixing speed is 100 mm/sec or less; however, when it is 200 mm/sec, the fixing fault and the cold offset are confirmed; that is, a sufficient image cannot be obtained. Accordingly, the curl of an image is not confirmed. Furthermore, the fixing strength of a fixed image, since, even at the fixing speed of 100 mm/sec, slight image defect is observed, is not confirmed under the speed condition higher than 200 mm/sec where the cold offset is generated.

Furthermore, when the toner used is measured, according to a method similar to example 1, of the flocculating property thereof, there is observed no flocculate; that is, it is confirmed that excellent powder fluidity is exhibited.

The minimum value of the relaxation elasticity H in the relaxation spectrum obtained from the frequency dependence of the dynamic viscoelasticity measurement of the toner contained in the developer is 9 $Pa/cm^2$ and the relaxation time $\lambda$ is 0.8 sec. Furthermore, the gradient K of the frequency dispersion curve of the storage elasticity at 60 degrees centigrade is 0.90 $Pa/cm^{2\cdot}$° C.

As described above, electrostatic latent image developing toners according to the invention used in examples exhibit excellent stripping property in the oil-less fixing at low temperatures, an improvement effect in the fixing speed dependence of the curl of the image and the fixing property, and the storage stability; however, toners used in comparative examples cause some problems in the fixing property, the curl of the image and so on.

What is claimed is:

1. An electrostatic latent image developing toner comprising, as a binder resin, a crystalline resin and at least one kind of non-crystalline resin, wherein, in a dynamic viscoelasticity measurement by a sine wave vibration method, a minimum value of the relaxation elasticity H in a relaxation spectrum obtained from frequency dispersion characteristics measured at 60 and 80 degrees centigrade with a measurement frequency set in the range of 0.1 to 100 rad/sec and measurement strain set in the range of 0.02 to 4.5% is in the range of 10 to 900 $Pa/cm^2$, and a relaxation time $\lambda$ corresponding to the minimum value is in the range of 1 to 10,000 sec.

2. The electrostatic latent image developing toner according to claim 1, wherein a gradient K of a frequency dispersion curve of the storage elasticity in the frequency dispersion characteristics measured at 60 degrees centigrade with the measurement frequency set in the range of 0.1 to 100 rad/sec and measurement strain set in the range of 0.02 to 4.5% is in the range of 0.12 to 0.87 $Pa/cm^{2\cdot}$° C.

3. The electrostatic latent image developing toner according to claim 1, wherein, in a section observation by a transmission electron microscope observation, the toner has a core/shell structure as a whole, and the crystalline resin crystal exists inside of the toner as an island structure in a sea structure of the non-crystalline resin.

4. The electrostatic latent image developing toner according to claim 3, wherein a shape of the crystalline resin crystal is block-shaped.

5. The electrostatic latent image developing toner according to claim 4, wherein an extended side length of the crystalline resin crystal is in the range of 0.5 to 1.5 μm.

6. The electrostatic latent image developing toner according to claim 3, wherein the toner has a core/shell structure as a whole, and the crystalline resin crystals and releasing agent crystals exist inside of the toner as an island structure in a sea structure of the non-crystalline resin.

7. The electrostatic latent image developing toner according to claim 6, wherein an extended side length of the releasing agent crystal is in the range of 0.5 to 1.5 μm.

8. The electrostatic latent image developing toner according to claim 6, wherein a shape of the releasing agent crystal is rod-shaped or block-shaped.

9. The electrostatic latent image developing toner according to claim 1, wherein the crystalline resin is at least one selected from a crystalline polyester resin and a crystalline vinyl resin.

10. The electrostatic latent image developing toner according to claim 1, wherein the melting point of the crystalline resin is in the range of 50 to 120 degrees centigrade.

11. The electrostatic latent image developing toner according to claim 1, wherein the crystalline resin is contained in the range of 5 to 70% by mass among components that constitute the binder resin.

12. The electrostatic latent image developing toner according to claim 1, wherein the non-crystalline resin is a non-crystalline polyester resin.

13. The electrostatic latent image developing toner according to claim 12, wherein the glass transition point of the non-crystalline resin is in the range of 60 to 90 degrees centigrade.

14. The electrostatic latent image developing toner according to claim 1, wherein a volume average particle size distribution index GSDv of the toner is 1.30 or less.

15. The electrostatic latent image developing toner according to claim 1, wherein a ratio of a volume average particle size distribution index GSDv of the toner to a number average particle size distribution index GSDp thereof, GSDv/GSDp, is 0.95 or more.

16. The electrostatic latent image developing toner according to claim 1, wherein a shape factor SF1 of the toner is in the range of 110 to 140.

17. A manufacturing method of the electrostatic latent image developing toner according to claim 1, comprising:

mixing at least a dispersion of resin particles in which a resin containing a crystalline resin having a volume average particle diameter of 1 μm or less is dispersed, a colorant dispersion in which a colorant is dispersed, and a releasing agent dispersion in which a releasing agent is dispersed, to form flocculated particles in the presence of an aluminum ion; and heating the flocculated particles, after growing the flocculated particles has been stopped, to fuse and unify the same.

18. The manufacturing method of the electrostatic latent image developing toner according to claim 17, wherein the dispersion further includes a dispersion of non-crystalline resin particles.

19. The manufacturing method of the electrostatic latent image developing toner according to claim 17, further comprising:

after the flocculating and before the fusing, adding and mixing a dispersion of resin particles in which resin particles of a non-crystalline resin are dispersed to and with a dispersion in which the flocculated particles are dispersed, to adhere the resin particles to the flocculated particles to form adhesion particles.

* * * * *